United States Patent [19]

Wray

[11] 3,990,613

[45] Nov. 9, 1976

[54] AEROSOL CONTAINER CLOSURE

[75] Inventor: John Robert Wray, Westerville, Ohio

[73] Assignee: Chill-Can International, Ltd., Houston, Tex.

[22] Filed: June 30, 1975

[21] Appl. No.: 592,058

[52] U.S. Cl. ..... 222/402.24
[51] Int. Cl.[2] ..... B65D 83/14
[58] Field of Search ..... 222/402.21, 402.22, 222/402.23, 402.24

[56] References Cited

UNITED STATES PATENTS 2,621,014 12/1952 Efford ..... 222/402.22 X

*Primary Examiner*—Allen N. Knowles
*Assistant Examiner*—Hadd Lane
*Attorney, Agent, or Firm*—Cushman, Darby & Cushman

[57] ABSTRACT

The present invention relates to a finger-actuated dispensing closure and valve for a pressurized container. More specifically, the closure is constructed to expand through absorption of propellant gases in said container to seal itself in the cylindrical mouth of a pressurized container, and to release the contents of the container when manually depressed.

6 Claims, 2 Drawing Figures

AEROSOL CONTAINER CLOSURE

Pressurized containers are widely used for packaging and dispensing a wide variety of products, including pesticides, personal care products such as anti-perspirants, hair sprays and shaving cream, household cleaning products, and paints. Generally the product contains a volatile liquid and/or gaseous propellant which is stored under pressure in the container and which propels the product through a narrow orifice when released. Typically, the closure of the container is equipped with a spring-loaded valve which is manually actuated to permit the propellant to drive the product through a small bore tube to the orifice. Because of the pressure within the container, it must be closed hermetically. In practice significant difficulty has been encountered in achieving a gas-tight seal in many containers, and, as a consequence, a substantial number of such containers are rendered useless by slow leakage of propellant.

The present invention provides a simple dispensing closure for a pressurized container which more effectively closes the container and which is inexpensive to manufacture. Briefly, the closure comprises a cylinder of swellable plastic which is forced into the cylindrical mouth of the container which is of substantially the same diameter as the closure. The propellant in the container is selected to swell the plastic closure to a controlled degree so that it is pressed against the mouth of the container, to form an effective seal.

The closure also is characterized by a new dispensing valve which is especially adapted for use with this closure, substantially reducing the cost of the closure. The dispensing valve is a cylindrical plug, positioned coaxially with the cylinder of swellable plastic. The plug has an internal bore, open at one end for release of the contents of the container and it is provided with one or more radial ports communicating between the central bore and the interior of the container. A self-supporting flap is provided to support the plug in position in the container and to cover the ports of the plug. The flap is constructed so that it folds away from the ports when the plug is depressed, thereby permitting the propellant to expel the product through the bore of the plug.

The invention will be more clearly understood by reference to the following detailed description of a preferred embodiment, reference being made to the drawing, in which:

FIG. 2 also illustrates a valve cap having a nozzle and a safety pressure release feature.

Figure 1:
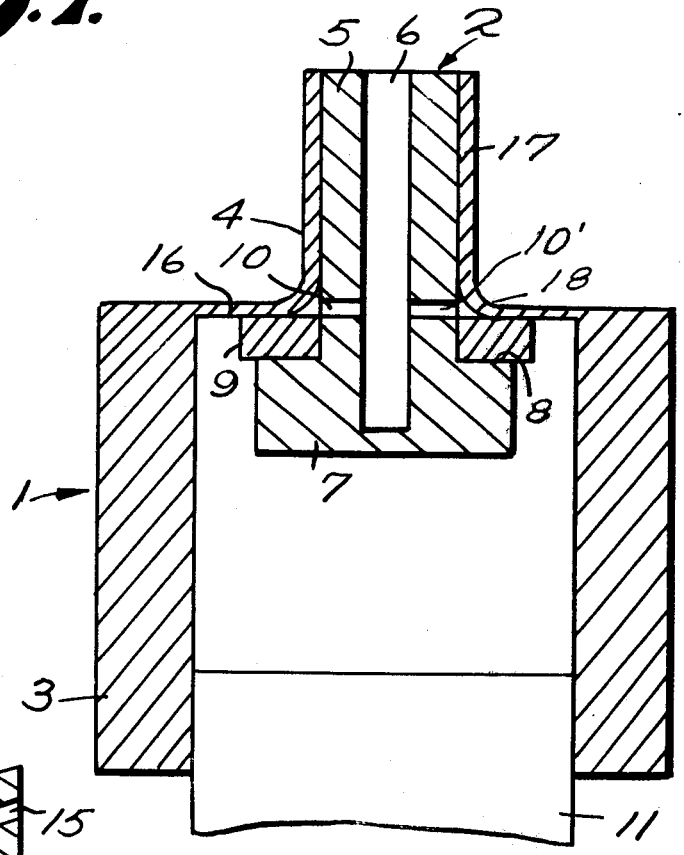
FIG. 1 is a cross section through a closure in accordance with the present invention, showing the valve closed.

Referring to FIG. 1, there is shown an outer closure, indicated generally at 1 and a plug shown generally at 2. The outer closure 1 comprises a relatively large diameter hollow cylinder 3 and a self-supporting resilient flap 4. The flap 4 extends radially inwardly from the upper end of cylinder 3, to the exterior of the plug and then axially upwardly along the exterior periphery of the plug.

The plug comprises a smaller cylinder 5 having a central, axially extending bore 6, opening through the top of the cylinder 5 and terminating above the bottom of the cylinder 5. The lower portion 7 of the plug has a larger diameter, thereby being provided with a radially outwardly extending valve seat 8 at the base of the smaller cylinder 5. A washer 9 covers the valve seat 8. Immediately above the washer 9, there are ports 10 and 10′ extending radially through the smaller cylinder 5 from its exterior to the bore 6, thereby communicating between the bore 6 and the interior of the hollow cylinder 3.

A dip tube 11, partially shown in FIG. 1, extends from the cylinder 3 to near the bottom of the container in which the closure is installed to receive the product and lead it upwardly to the ports 10 and 10′.

Figure 2:
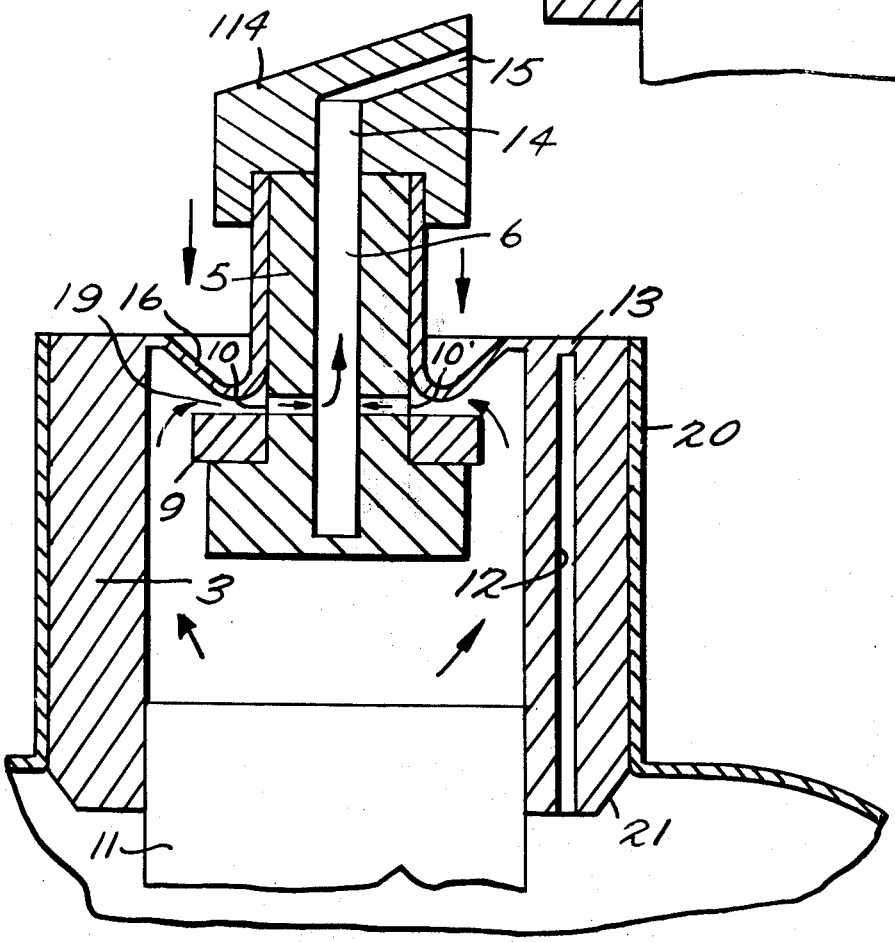
FIG. 2 is a similar view, showing the valve opened, and illustrating a portion of the container in which the closure is used.

As seen in FIG. 2, the large diameter cylinder 3 preferably is provided with a safety release feature comprising a small diameter bore 12 extending axially from the bottom of the cylinder to near its top, leaving a thin covering of plastic at 13. This covering is thick enough to resist the pressure of the container at ordinary temperatures, say up to 125° F, but thin enough to rupture and release the propellant if excessive pressure builds up in the container. This action is expedited if the container is overheated, since the thin plastic covering at 13 is softened if the plastic is thermoplastic.

FIG. 2 also illustrates a cap 114 over the small cylinder 5, provided with a bore 14, which is axially aligned and open to the bore 6 of the small cylinder 5. The bore 14 opens into an upwardly inclined bore 15 which provides a narrow orifice for expulsion of the product in a fine mist, or the bore 15 may be somewhat larger with a small apertured cap at its upper end.

The action of the flap 4 is illustrated in FIGS. 1 and 2. As seen in FIG. 1, the flap comprises a radially inwardly extending section 16, which is integrally connected with the top of cylinder 3 and extends horizontally across the outer portion of valve seat 8. The flap also includes a tubular section 17 which extends upwardly along the small cylinder 5. The tubular section 17 may have an interior diameter slightly smaller than the exterior diameter of small cylinder 5, so that the tubular section 17 is pressed tightly against the exterior of the small cylinder 5. The tubular section 17 may be thinner than the horizontal section 16 of the flap 4 to facilitate insertion of the small cylinder 5.

The flap 4 also has an arcuate section 18 connecting between the tubular section 17 and the horizontal section 16. The arcuate section 18 curves past the ports 10 and 10′, but need not actually cover them, as the valve is closed by drawing the plug upwardly until the horizontal section 16 is seated on the gasket 9. In the closed position of the valve, as shown in FIG. 1, the horizontal section 16 is essentially flat and it resiliently urges the washer 9 against itself. The pressure within the container also urges the valve closed. However, when the cap 114 is depressed, the flap 4 is curled or rolled upwardly away from the gasket 9, as shown in FIG. 2, and rolls outwardly away from the ports 10 and 10′, providing a passageway at 19 for the product to flow to the ports.

The closure is installed in a cylindrical mouth of a container, shown at 20, which ordinarily will be constructed of steel. Preferably, the cylindrical mouth of the container is tapered inwardly and upwardly, in which case the closure will be inserted from the bottom. Alternatively, the closure may be tapered downwardly and outwardly. Insertion can be facilitated by a chamfered edge at the bottom of the cylinder 3 as shown in FIG. 2. If the closure is inserted from the bottom, the chamfered edge will be at the top rather than at the bottom of the closure. The closure is held in the container by outward pressure of the cylinder 3. This pressure is achieved partly by the relationship between the exterior diameter of cylinder 3 and the interior diameter of the mouth 20, and partly by controlled swelling of the cylinder 3 by propellant in the container. The mouth 20 typically will have an interior diameter of 1/16 to ¾ inch and the cylinder 3 typically will have a diameter of 1/16 to ¾ inch. In general, it is preferred that the exterior diameter of the cylinder is 0.002 to 0.010 inch larger than the interior diameter of mouth 20. This effect is increased when the cylinder 3 is swollen by propellant. The cylinder 3 may be ⅛ to 1 inch long and generally will be 0.020 to 0.200 inch thick.

The swelling action of the cylinder is achieved by selecting a plastic material which is swollen by the propellant. Using Freon propellants, high density polyethylene has been found to be a particularly useful plastic, especially with Freon 12 & R500. However, in any instance, the swelling characteristic can be measured readily by storing the plastic in contact with the propellant in the vapor state over sufficient liquid to saturate the vapor, at 25° C and measuring the volume increase of the plastic as a percentage of the original volume after there has been sufficient time for the plastic to equilibrate with the vapor. It is desired that the plastic swell 0.01 to 5%, based on this test. Excessive swelling is not desired, for example because it may rupture the steel container through excessive pressure, whereas insufficient swelling may lead to the plastic closure being ejected from the container.

It is preferred that the horizontal portion 16 of the flap 4 is 0.001 to 0.050 inch thick and that the plastic safety valve at 13 is 0.0005 to 0.002 inch thick.

It will be appreciated that it is possible to depart from the details of construction and mode of operation described above solely for purposes of illustration within the scope of the invention.

A different combination of plastic and propellant which varies the swell rate of the plastic would modify somewhat the dimensions and percentages listed previously.

What is claimed is:

1. In a package comprising a pressurized container containing a product and a propellant under pressure to expel said product from said container, a closure and a dispensing valve which releases said product through said closure;

the improvement wherein said closure comprises a swellable plastic which is swollen by said propellant 0.01 to 5%, said container having a cylindrical mouth and said closure comprising a swellable plastic cylinder of substantially the same diameter as said cylindrical mouth and in contact with said cylindrical mouth so that the swelling of the plastic cylinder presses it against said mouth.

2. A package as set forth in claim 1 wherein said closure is a hollow cylinder through which said product flows when it is dispensed.

3. A package as set forth in claim 2, in which said valve includes a plug at least partially within said hollow cylinder closure, said plug having an interior bore and at least one radial port communicating between said interior bore and the interior of said hollow cylinder, and said plug having a valve seat extending radially outwardly from said plug adjacent said port, and a self-supporting flap extending radially inwardly from said hollow cylinder closure, across said valve seat, arcuately past said port and in sealing contact with the exterior of said plug, above said port, said flap resiliently urging said valve seat against itself to close said container and rolling away from said valve seat and said port when said plug is depressed to permit the propellant to expel said product from the container.

4. A package as set forth in claim 3 in which said flap is integral with said hollow cylinder closure.

5. A package as set forth in claim 3 including a washer on said valve seat to seal against said flap.

6. A dispensing valve for a pressurized container comprising a plug having an interior bore and at least one radial port communicating with said interior bore and said plug having a valve seat extending radially outwardly from said plug adjacent said port, and a self-supporting flap extending radially inwardly across said valve seat, arcuately past said port and in sealing contact with the exterior of said plug above said port, said flap resiliently urging itself against said valve seat to close the valve, and rolling away from said valve seat and said port when said plug is depressed to permit the product to be expelled through said port and said interior bore.

* * * * *